US012221804B2

(12) United States Patent
Yao

(10) Patent No.: US 12,221,804 B2
(45) Date of Patent: Feb. 11, 2025

(54) SWIMMING POOL WITH ADJUSTABLE SHADING ANGLE

(71) Applicant: Jiangsu Comco Outdoor Products Co., Ltd., Huaian (CN)

(72) Inventor: Liang Yao, Huaian (CN)

(73) Assignee: Jiangsu Comco Outdoor Products Co., Ltd., Huaian (CN)

( * ) Notice: Subject to any disclaimer, the term of this patent is extended or adjusted under 35 U.S.C. 154(b) by 169 days.

(21) Appl. No.: 18/090,602

(22) Filed: Dec. 29, 2022

(65) Prior Publication Data

US 2024/0218692 A1 Jul. 4, 2024

(51) Int. Cl.

| | |
|---|---|
| ***E04H 4/10*** | (2006.01) |
| ***E04H 4/00*** | (2006.01) |
| ***E04H 4/14*** | (2006.01) |
| ***E04H 15/02*** | (2006.01) |
| ***E04H 15/36*** | (2006.01) |
| ***E04H 15/40*** | (2006.01) |
| ***E04H 15/58*** | (2006.01) |
| ***E04H 15/64*** | (2006.01) |

(52) U.S. Cl.

CPC ..... *E04H 4/108* (2013.01); *E04H 4/0025* (2013.01); *E04H 4/14* (2013.01); *E04H 15/02* (2013.01); *E04H 15/40* (2013.01); *E04H 15/58* (2013.01); *E04H 15/64* (2013.01); *E04H 15/36* (2013.01)

(58) Field of Classification Search

CPC ..... E04H 4/108; E04H 4/0025; E04H 4/14; E04H 15/02; E04H 15/40; E04H 15/58; E04H 15/64; E04H 15/36; B63B 17/02; B60J 7/10; B60J 7/102; B60J 7/104

USPC ..... 135/96, 117, 119, 120.4, 137, 88.01, 135/88.02; 4/498, 503, 507; 114/361

See application file for complete search history.

(56) References Cited

U.S. PATENT DOCUMENTS

| | | | | |
|---|---|---|---|---|
| 765,018 | A * | 7/1904 | Langgons | A47C 17/64 135/121 |
| 2,567,697 | A * | 9/1951 | Craighead, Jr. | E04H 15/04 135/90 |
| 6,272,695 | B1 * | 8/2001 | Brandner | E04H 4/108 4/498 |
| D538,876 | S * | 3/2007 | Peterson | D21/803 |
| 7,424,862 | B1 * | 9/2008 | Wagner | B63B 17/02 114/364 |

(Continued)

FOREIGN PATENT DOCUMENTS

| | | |
|---|---|---|
| CN | 212562673 U | 2/2021 |

*Primary Examiner* — Robert Canfield

(74) *Attorney, Agent, or Firm* — Bayramoglu Law Offices LLC

(57) ABSTRACT

A swimming pool with an adjustable shading angle is provided. The swimming pool includes a swimming pool body and an awning, the awning is arranged on the swimming pool body; and the opening of the swimming pool body faces upward and is provided with a water chamber. The awning includes a piece of tarpaulin, a bracket and a fixing rope, and the piece of tarpaulin is installed above the swimming pool body through the bracket. One end of the fixing rope is connected to the piece of tarpaulin, and the other end is detachable and connected to the swimming pool body; the swimming pool body is provided with a plurality of bases in different positions, the shading angle of the piece of tarpaulin is changed by connecting the fixing rope to different bases.

16 Claims, 2 Drawing Sheets

(56) References Cited

U.S. PATENT DOCUMENTS

| | | | | |
|---|---|---|---|---|
| 7,721,361 | B1 * | 5/2010 | Shubert | E04H 4/084 4/494 |
| 8,757,185 | B1 * | 6/2014 | Muzzio | B63B 17/02 114/361 |
| 8,899,251 | B2 * | 12/2014 | Leung | E04H 15/40 135/96 |
| 10,017,956 | B1 * | 7/2018 | Chiang | A47D 13/066 |
| D861,109 | S * | 9/2019 | He | D21/815 |
| D983,301 | S * | 4/2023 | Chen | D21/815 |
| D987,114 | S * | 5/2023 | Yao | D25/2 |
| D995,685 | S * | 8/2023 | Yao | D21/815 |
| D1,006,256 | S * | 11/2023 | Yao | D25/2 |
| 12,037,793 | B2 * | 7/2024 | Blizzard | B63B 17/02 |
| 2006/0162062 | A1 * | 7/2006 | Liu | E04H 4/0025 4/506 |
| 2007/0141925 | A1 * | 6/2007 | Turner | A47C 15/006 114/345 |
| 2013/0092205 | A1 * | 4/2013 | Leung | E04H 4/0025 135/90 |
| 2020/0240162 | A1 * | 7/2020 | van den Bosch | E04H 4/108 |
| 2021/0131138 | A1 * | 5/2021 | Hoving Junior | E04H 4/10 |
| 2023/0019618 | A1 * | 1/2023 | Repoulis | B63B 17/02 |
| 2024/0209646 | A1 * | 6/2024 | Yao | E04H 4/0056 |

* cited by examiner

SWIMMING POOL WITH ADJUSTABLE SHADING ANGLE

TECHNICAL FIELD

The present invention relates to the technical field of an inflatable swimming pool, in particular to a swimming pool with an adjustable shading angle.

BACKGROUND

Swimming, as a kind of sports favored by most people, can improve the function of the heart and lung, promote the increase of lung capacity, and improve the function of the heart. It can also promote the burning of fat, which is good for building muscle and reducing fat. In order to expand the application scenes of the swimming pool, inflatable swimming pools emerge. The inflatable swimming pool is popular because of its characteristics such as being easy to be moved and stored, and easy to be carried because of light weight.

Since most of the swimming pools are used outdoors in summer, it is necessary for the inflatable swimming pool to have a shading structure. For example, CN212562673U discloses a kind of inflatable swimming pool, which uses a multi-layer inflatable air bag structure and has a longitudinal overlay setting, so as to ensure the water storage, greatly improve the stability of the water storage. Each ring inflatable air bag can be individually inflated and deflated. An awning is set above a swimming pool body, which is suitable for shading part of the sun outdoor, and avoiding direct sunlight on the face.

The applicant believes that although the above swimming pool solves the problem of shading through the awning, when the angle of sunlight is different, the awning cannot change its angle and the shading effect is poor. Therefore, it is necessary to provide a swimming pool that can adjust the angle of the awning.

SUMMARY

In order to overcome the shortcomings of the prior art, the present invention aims to provide a swimming pool with an adjustable shading angle to solve the problems mentioned in the background art.

To realize the above purpose, the present invention employs the following technical solutions:

A swimming pool with an adjustable shading angle, where the swimming pool includes a swimming pool body and an awning, the awning is arranged on the swimming pool body; the opening of the swimming pool body faces upward and is provided with a water chamber.

The awning includes a piece of tarpaulin, a rod and a strap, and the piece of tarpaulin is installed above the swimming pool body through the rod; one end of the strap is connected to the piece of tarpaulin, and the other end is detachable and connected to the swimming pool body; the swimming pool body is provided with a plurality of bases in different positions, the shading angle of the piece of tarpaulin is changed by connecting the strap to different bases.

Further, the swimming pool body includes a soft side sheet enclosing a wall of the pool and a soft substrate as the bottom of the pool; the pool opening and the pool bottom of the swimming pool body are both provided with inflatable rings, the inflatable rings are inflatable air bags.

Furthermore, inflatable rings at the pool opening of the swimming pool body includes a top inflatable ring and a middle inflatable ring, and the top inflatable ring and the middle inflatable ring are vertically superimposed.

Furthermore, the outer side of each inflatable ring is provided with an air valve that can be used for inflation and deflation.

Further, the piece of tarpaulin includes a tarpaulin inner sheet and a tarpaulin side sheet, and the tarpaulin inner sheet and the tarpaulin side sheet are sewn together; the tarpaulin inner sheet is provided with a rod sleeve, and the rod is disposed in the rod sleeve to keep the tarpaulin inner sheet in an arch shape.

Furthermore, the base includes a strap base and a storage rope base; when the strap is connected with the strap base, the tarpaulin side sheet is expanded to increase the shading area; when the strap is connected with the storage rope base, the tarpaulin side sheet is folded to reduce the shading area.

Furthermore, the tarpaulin inner sheet is arranged on the swimming pool body through two parallel rods, the rods are located on the opposite sides of the tarpaulin inner sheet, and the two ends of the rods are arranged on the swimming pool body.

Furthermore, the tarpaulin side sheet is provided with a through hole for connecting a strap.

Furthermore, the swimming pool body is provided with a water outlet.

Compared with the prior art, the present invention has the following beneficial effects:

The top inflatable ring and the middle inflatable ring constitute the upper and lower double-layer inflatable structure to support the shape of swimming pool opening. Even if one of the layers leaks, it does not affect the use of the whole swimming pool, increasing the service life of the swimming pool. The bottom inflatable ring can be inflated to open the bottom of the swimming pool, make the bottom of swimming pool more flat, maintain the bottom shape of the swimming pool, so that it is convenient for consumers to use when filling water.

The piece of tarpaulin is formed by a number of tarpaulin side sheets and a tarpaulin inner sheet in a fixed splicing form, the strap is installed on the tarpaulin side sheet, the angle of the tarpaulin side sheet is changed by traction of the strap to increase or reduce the shading area, so that the shading area of the awning can be adjusted.

BRIEF DESCRIPTION OF THE DRAWINGS

In order to explain the technical solutions of embodiments of the present invention more clearly, the accompany drawings required for the description of the embodiments are briefly introduced below. It is obvious that the accompany drawings described below are only some embodiments of the present invention. A person skilled in the art can also obtain other accompany drawings according to these accompany drawings without creative efforts.

In the figures, referential numbers are as follows.

1—swimming pool body; 2—awning; 3—top inflatable ring; 4—middle inflatable ring; 5—bottom inflatable ring; 6—soft side sheet; 7—soft substrate; 8—side water outlet; 9—bottom water outlet; 10—strap; 11—strap base; 12—tarpaulin; 13—tarpaulin inner sheet; 14—tarpaulin side sheet; 15—rod base; 16—rod sleeve; 17—storage rope base; 18—air valve.

DETAILED DESCRIPTION OF THE EMBODIMENTS

In order to explain the present invention more clearly, the present invention is further explained in detail in combination with the embodiments and the accompany drawings. A person skilled in the art should understand that the following specific descriptions are illustrative rather than restrictive and shall not limit the protection scope of the present invention.

In the description of the present invention, it needs to be noted that the orientation or position relationship indicated by terms such as "inside", "outside", "up" and "down" is based on the orientation or position relationship shown in the accompany drawings, and is only for the convenience of describing the present invention and simplifying the description, but not for indicating or implying that the device or element referred to must have a specific orientation, construction and operation in a specific orientation. Therefore, it cannot be understood as the limitation to the present invention. In addition, unless otherwise expressly specified and restricted, the terms such as "install", "connect" shall be interpreted broadly. For example, it may be a fixed connection, a detachable connection or an integrated connection. It may be a mechanical connection or an electrical connection. It may be a direct connection, an indirect connection through an intermediary, or it may be an internal connection within two components. For a person skilled in the art, the specific meanings of the above terms in the present invention can be understood according to the specific circumstances.

EMBODIMENTS

Figure 1:
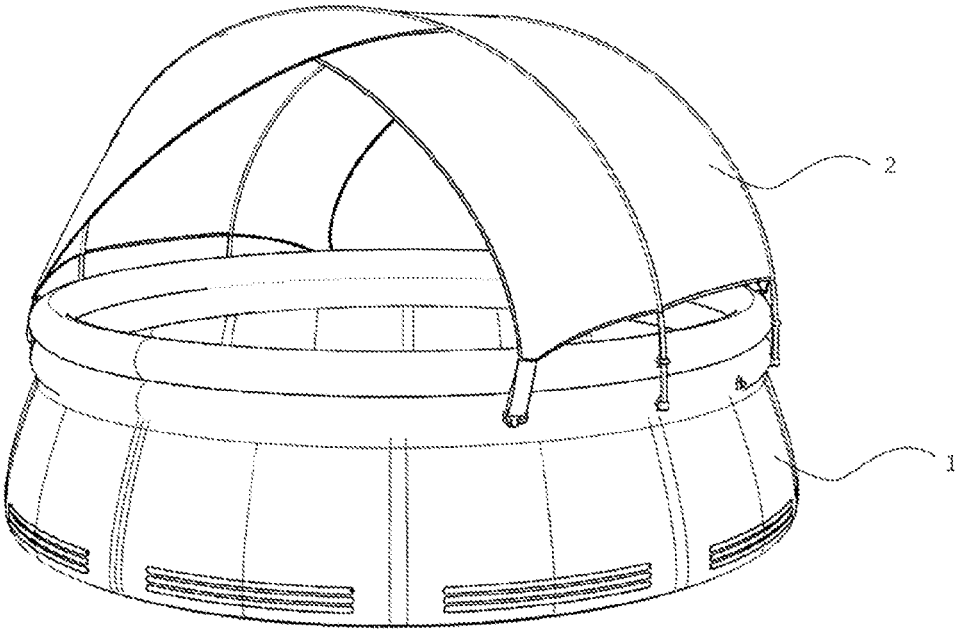
FIG. 1 is a schematic diagram of the overall structure of an embodiment of the present invention.
Figure 2:
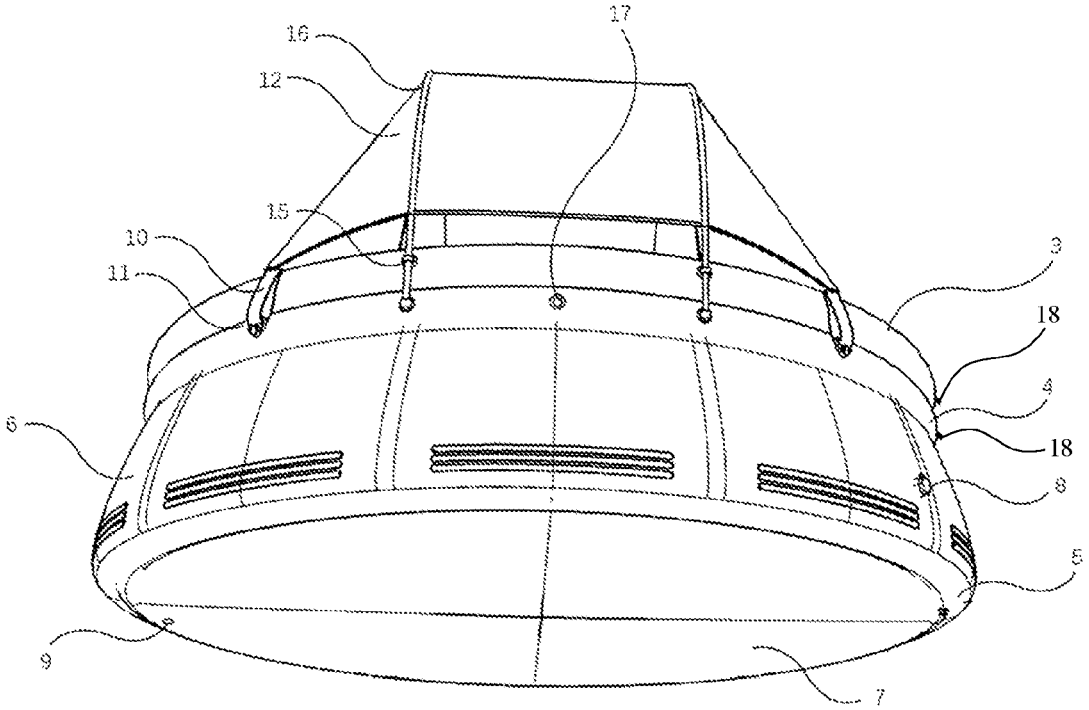
FIG. 2 is a schematic diagram of the overall structure of the embodiment of the present invention from another perspective.
Figure 3:
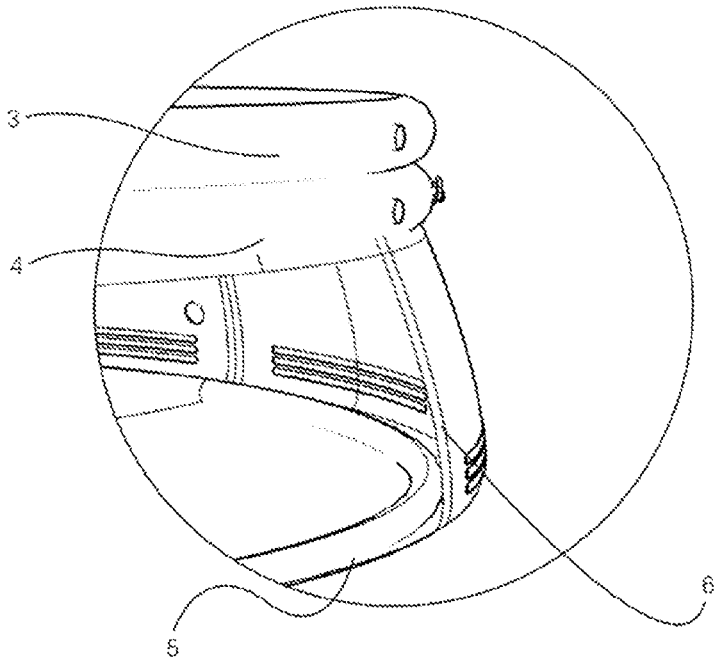
FIG. 3 is a partial magnification schematic diagram of a swimming pool body of the embodiment of the present invention.
Figure 4:
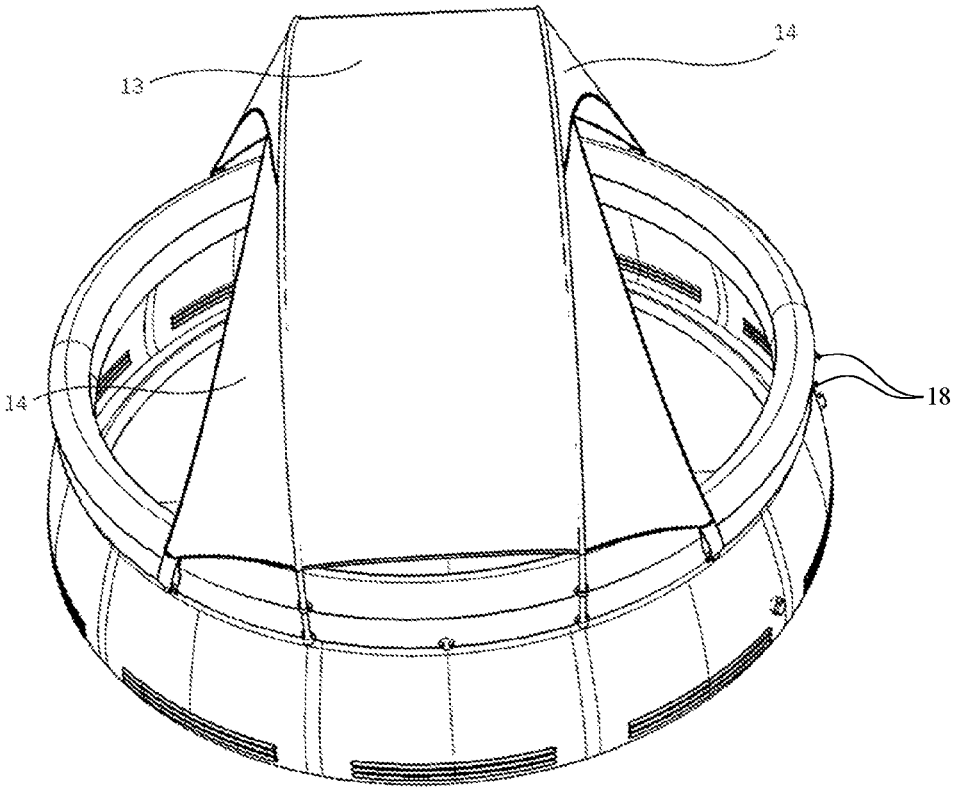
FIG. 4 is a schematic diagram of the awning structure of the embodiment of the present invention.

A swimming pool with an adjustable shading angle as shown in FIG. 1 to FIG. 4, where the swimming pool includes a swimming pool body 1 and an awning 2, the awning 2 is arranged on the swimming pool body 1; the opening of the swimming pool body 1 faces upward and is provided with a water chamber, the swimming pool body 1 includes a soft side sheet 6 enclosing a wall of the pool and a soft substrate 7 as the bottom of the pool. The advantage of using soft materials is that it saves space when the swimming pool needs to be stored and carried. There are a side water outlet 8 and a bottom water outlet 9 on the pool wall and pool bottom of swimming pool body 1, respectively. When the water needs to be drained/changed, the two water outlets can work at the same time to improve the work efficiency.

The pool opening and the pool bottom of the swimming pool body 1 are both provided with inflatable rings, the inflatable rings are inflatable air bags. In the present embodiment, inflatable rings at the pool opening of the swimming pool body 1 includes a top inflatable ring 3 and a middle inflatable ring 4, and the top inflatable ring 3 and the middle inflatable ring 4 are vertically overlaid. The top inflatable ring 3 and the middle inflatable ring 4 constitute the upper and lower double-layer inflatable structure to support the shape of swimming pool opening. Even if one of the layers leaks, it does not affect the use of the whole swimming pool, increasing the service life of the swimming pool. The bottom inflatable ring 5 can be inflated to open the bottom of the swimming pool, make the bottom of swimming pool more flat, maintain the bottom shape of the swimming pool, so that it is convenient for consumers to use when filling water. The air chambers of the top inflatable ring 3, the middle inflatable ring 4 and the bottom inflatable ring 5 are independent of each other. The outside of each inflatable ring is connected with an air valve 18 that can be used for inflation and deflation. Each inflatable ring is inflated and deflated independently.

The awning 2 includes a piece of tarpaulin 12, a rod and a strap 10, and the piece of tarpaulin 12 is installed above the swimming pool body 1 through the rod. One end of the strap 10 is connected to the piece of tarpaulin 12. Specifically, a tarpaulin side sheet 14 is provided with a through hole for connecting the strap 10. The other end is detachable and connected to the swimming pool body 1. The piece of tarpaulin 12 includes a tarpaulin inner sheet 13 and the tarpaulin side sheet 14, and the tarpaulin inner sheet 13 and the tarpaulin side sheet 14 are sewn together. Further, the tarpaulin inner sheet 13 is provided with a rod sleeve 16, and the rod is disposed in the rod sleeve 16 to keep the tarpaulin inner sheet 13 in an arch shape. The tarpaulin inner sheet 13 is arranged on the swimming pool body 1 through two parallel rods, the rods are located on the opposite sides of the tarpaulin inner sheet 13, and the two ends of the rods are arranged on the swimming pool body 1.

The swimming pool body 1 is provided with a plurality of bases in different positions, the shading angle of the piece of tarpaulin 12 is changed by connecting the strap 10 to different bases. The base includes a strap base 11 and a storage rope base 17; when the strap 10 is connected with the strap base 11, the tarpaulin side sheet 14 is expanded to increase the shading area; when the strap 10 is connected with the storage rope base 17, the tarpaulin side sheet 14 is folded to reduce the shading area. See FIG. 4 for details. It can be seen that the strap base 11 is located between the rod bases 15 of the same rod, and the storage rope base 17 is located between the rod bases 15 of two rods. When the strap 10 is connected to the strap base 11, the tarpaulin side sheet 14 would be expanded to increase the shading angle of the piece of tarpaulin 12. When the strap 10 is connected to the storage rope base 17, the tarpaulin side sheet 14 would be tight along the rod to reduce the shading angle of the piece of tarpaulin 12.

Obviously, the above embodiments of the present invention are only examples to explain the present invention more clearly, but not the limitation to the embodiments of the present invention. For a person skilled in the art, other changes or alternations in different forms can be made on the basis of the above description. It is not possible to give an exhaustive list of all the embodiments here. All obvious changes or alterations derived from the technical solutions of the present invention are still within the protection scope of the present invention.

What is claimed is:

1. A swimming pool with an adjustable shading angle, wherein the swimming pool comprises a swimming pool body and an awning, the awning is arranged on the swimming pool body; an opening of the swimming pool body faces upward and is provided with a water chamber, wherein, the awning comprises a piece of tarpaulin, a rod and a strap, and the piece of tarpaulin is installed above the swimming pool body by inserting the rod into the tarpaulin; a first end of the strap is connected to the piece of tarpaulin, and a second end of the strap is detachable and connected to the swimming pool body;

the swimming pool body is provided with a plurality of bases in different positions, a shading angle of the piece of tarpaulin is changed by connecting the strap to different bases.

2. The swimming pool according to claim 1, wherein the swimming pool body comprises a side sheet and a substrate, wherein the side sheet encloses a wall of the swimming pool, and the substrate is as a bottom of the swimming pool; a pool opening and a pool bottom of the swimming pool body are provided with inflatable rings, the inflatable rings are inflatable air bags.

3. The swimming pool according to claim 2, wherein inflatable rings at the pool opening of the swimming pool body comprises a top inflatable ring and a middle inflatable ring, and the top inflatable ring and the middle inflatable ring are vertically superimposed.

4. The swimming pool according to claim 2, wherein an outer side of each of the inflatable rings is provided with an air valve, wherein the air valve is configured for inflation and deflation.

5. The swimming pool according to claim 1, wherein the piece of tarpaulin comprises a tarpaulin inner sheet and a tarpaulin side sheet, and the tarpaulin inner sheet and the tarpaulin side sheet are sewn together; the tarpaulin inner sheet is provided with a rod sleeve, and the rod is disposed in the rod sleeve to keep the tarpaulin inner sheet in an arch shape.

6. The swimming pool according to claim 5, wherein the plurality of bases comprises a strap base and a storage rope base; when the strap is connected with the strap base, the tarpaulin side sheet is expanded to increase a shading area; when the strap is connected with the storage rope base, the tarpaulin side sheet is folded to reduce the shading area.

7. The swimming pool according to claim 5, wherein the tarpaulin inner sheet is arranged on the swimming pool body through two parallel rods, the two parallel rods are located on the opposite sides of the tarpaulin inner sheet, and the two ends of each of the two parallel rods are arranged on the swimming pool body.

8. The swimming pool according to claim 5, wherein the tarpaulin side sheet is provided with a through hole for connecting the strap.

9. The swimming pool according to claim 1, wherein the swimming pool body is provided with a water outlet.

10. The swimming pool according to claim 2, wherein the swimming pool body is provided with a water outlet.

11. The swimming pool according to claim 3, wherein the swimming pool body is provided with a water outlet.

12. The swimming pool according to claim 4, wherein the swimming pool body is provided with a water outlet.

13. The swimming pool according to claim 5, wherein the swimming pool body is provided with a water outlet.

14. The swimming pool according to claim 6, wherein the swimming pool body is provided with a water outlet.

15. The swimming pool according to claim 7, wherein the swimming pool body is provided with a water outlet.

16. The swimming pool according to claim 8, wherein the swimming pool body is provided with a water outlet.

* * * * *